US012454747B1

(12) United States Patent
Yang et al.

(10) Patent No.: US 12,454,747 B1
(45) Date of Patent: Oct. 28, 2025

(54) EFFICIENT AGING METHODS FOR ALUMINUM-LITHIUM ALLOYS BASED ON DYNAMIC STRAIN PRECIPITATION

(71) Applicant: CHONGQING UNIVERSITY OF ARTS AND SCIENCES, Chongqing (CN)

(72) Inventors: Xusheng Yang, Chongqing (CN); Weijiu Huang, Chongqing (CN); Xin Wang, Chongqing (CN); Xianghui Zhu, Chongqing (CN)

(73) Assignee: CHONGQING UNIVERSITY OF ARTS AND SCIENCES, Chongqing (CN)

( * ) Notice: Subject to any disclaimer, the term of this patent is extended or adjusted under 35 U.S.C. 154(b) by 0 days.

(21) Appl. No.: 18/915,343

(22) Filed: Oct. 14, 2024

Related U.S. Application Data

(63) Continuation-in-part of application No. PCT/CN2023/128326, filed on Oct. 31, 2023.

(30) Foreign Application Priority Data

Aug. 9, 2023 (CN) ..... 202310999059.5

(51) Int. Cl.
*C22F 1/057* (2006.01)
*C22C 21/14* (2006.01)
(Continued)

(52) U.S. Cl.
CPC ..... *C22F 1/057* (2013.01); *C22C 21/14* (2013.01); *C22C 21/16* (2013.01); *C22C 21/18* (2013.01)

(58) Field of Classification Search
None
See application file for complete search history.

(56) References Cited

U.S. PATENT DOCUMENTS 4,830,682 A 5/1989 Ashton et al.
2016/0115576 A1 4/2016 Long et al.

FOREIGN PATENT DOCUMENTS

CN 108359920 A 8/2018
CN 110791720 A 2/2020
(Continued)

OTHER PUBLICATIONS

Notification to Grant Patent Right for Invention in Chinese Application No. 202310999059.5 mailed on May 15, 2024, 7 pages.

*Primary Examiner* — Brian D Walck

(57) ABSTRACT

Disclosed is an efficient aging method for an aluminum-lithium alloy based on dynamic strain precipitation, comprising ingot casting, homogenization treatment, hot rolling, solution heat treatment and quenching, and aging treatment. The method further comprises temperature-controlled and rate-controlled deformation treatment between the solution heat treatment and quenching and the aging treatment, the temperature-controlled and rate-controlled deformation treatment includes performing preheating, temperature-controlled and rate-controlled hot rolling, and cooling treatment on an aluminum-lithium alloy sheet after the solution heat treatment and quenching in sequence, the temperature-controlled and rate-controlled hot rolling has a rolling temperature of 250° C.-330° C., a rolling reduction of 10%-30%, and a strain rate of 0.001 $s^{-1}$-0.5 $s^{-1}$, and an alloy chemical composition of the aluminum-lithium alloy includes Cu: 2.7 wt %-2.8 wt %, Li: 1.7 wt %-1.9 wt %, Mg: 0.3 wt %-0.5 wt %, Mn: 0.3 wt %-0.5 wt %, Zn: 0.5 wt %-0.7 wt %, Zr: 0.08 wt %-0.12 wt %, Si≤0.05 wt %, and Fe≤0.07 wt %.

5 Claims, 3 Drawing Sheets

(51) Int. Cl.
*C22C 21/16* (2006.01)
*C22C 21/18* (2006.01)

(56) References Cited

FOREIGN PATENT DOCUMENTS

| | | | | | |
|---|---|---|---|---|---|
| CN | 112281035 | A | * | 1/2021 | ..... C22C 21/18 |
| CN | 112981198 | A | | 6/2021 | |
| CN | 112981284 | A | | 6/2021 | |
| CN | 114369776 | A | | 4/2022 | |
| CN | 114934212 | A | * | 8/2022 | ..... C22C 21/00 |
| CN | 115418534 | A | | 12/2022 | |
| KR | 100756433 | B1 | | 9/2007 | |

* cited by examiner

EFFICIENT AGING METHODS FOR ALUMINUM-LITHIUM ALLOYS BASED ON DYNAMIC STRAIN PRECIPITATION

CROSS-REFERENCE TO RELATED APPLICATIONS

This application is a continuation-in-part application of International Application No. PCT/CN2023/128326, filed on Oct. 31, 2023, which claims priority of Chinese Patent Application No. 202310999059.5, filed on Aug. 9, 2023, the entire contents of each of which are incorporated herein by reference.

TECHNICAL FIELD

The present disclosure relates to the technical field of heat treatment of aluminum-lithium alloys, and in particular, to an efficient aging method for an aluminum-lithium alloy based on dynamic strain precipitation.

BACKGROUND

The new aluminum-lithium alloy (Al—Cu—Li system) is an aging-strengthened deformed aluminum alloy with excellent specific strength, specific stiffness, and fracture toughness, which is an ideal structural material for aerospace vehicles. The excellent comprehensive mechanical properties of the new aluminum-lithium alloy depend on the precipitation of a main reinforcing phase-$T_1$ phase during the aging process. An important direction for research of the new aluminum-lithium alloy is how to increase the precipitation amount of the $T_1$ phase during the aging process.

Therefore, it is necessary to provide an efficient aging method for an aluminum-lithium alloy based on dynamic strain precipitation to effectively increase the precipitation amount of the $T_1$ phase during the aging process, thereby ensuring the comprehensive mechanical properties of the new aluminum-lithium alloy.

SUMMARY

One or more embodiments of the present disclosure provide an efficient aging method for an aluminum-lithium alloy based on dynamic strain precipitation, comprising ingot casting, homogenization treatment, hot rolling, solution heat treatment and quenching, and aging treatment, wherein the method further comprises temperature-controlled and rate-controlled deformation treatment between the solution heat treatment and quenching and the aging treatment, the temperature-controlled and rate-controlled deformation treatment includes performing preheating, temperature-controlled and rate-controlled hot rolling, and cooling treatment on an aluminum-lithium alloy sheet after the solution heat treatment and quenching in sequence, the temperature-controlled and rate-controlled hot rolling has a rolling temperature of 250° C.-330° C., a rolling reduction of 10%-30%, and a strain rate of 0.001 $s^{-1}$-0.5 $s^{-1}$, and an alloy chemical composition of the aluminum-lithium alloy includes Cu: 2.7 wt %-2.8 wt %, Li: 1.7 wt %-1.9 wt %, Mg: 0.3 wt %-0.5 wt %, Mn: 0.3 wt %-0.5 wt %, Zn: 0.5 wt %-0.7 wt %, Zr: 0.08 wt %-0.12 wt %, Si≤0.05 wt %, and Fe≤0.07 wt %.

One or more embodiments of the present disclosure provide an efficient aging method for an aluminum-lithium alloy based on dynamic strain precipitation, comprising: (1) preparing an aluminum-lithium alloy ingot by a vacuum melting and casting method, wherein alloy chemical composition of the aluminum-lithium alloy includes Cu: 2.7 wt %-2.8 wt %, Li: 1.7 wt %-1.9 wt %, Mg: 0.3 wt %-0.5 wt %, Mn: 0.3 wt %-0.5 wt %, Zn: 0.5 wt %-0.7 wt %, Zr: 0.08 wt %-0.12 wt %, Si≤0.05 wt %, Fe≤0.07 wt %, and the balance is aluminum; (2) performing homogenization treatment on the aluminum-lithium alloy ingot at a range of 510° C.-530° C. for 70 h-80 h; (3) preheating the homogenized aluminum-lithium alloy ingot at a range of 420° C.-460° C., and after the whole homogenized aluminum-lithium alloy ingot reaches a preheat temperature, holding for 20 min-40 min, and then performing hot rolling on the homogenized aluminum-lithium alloy ingot to obtain an aluminum-lithium alloy sheet; (4) performing solution heat treatment on the aluminum-lithium alloy sheet at a range of 535° C.-545° C. for 0.5 h-1.5 h, followed by quenching in cold water at 25° C.; (5) preheating the quenched aluminum-lithium alloy sheet to the rolling temperature of temperature-controlled and rate-controlled hot rolling within a range of 2 min-8 min, and then performing the temperature-controlled and rate-controlled hot rolling, wherein the temperature-controlled and rate-controlled hot rolling has the rolling temperature of 250° C.-330° C., a rolling reduction of 10%-30%, and a strain rate of 0.001 $s^{-1}$-0.1 $s^{-1}$, followed by air cooling to room temperature; and (6) aging the aluminum-lithium alloy sheet after the temperature-controlled and rate-controlled hot rolling at 160° C. for 8 h-15 h, followed by air cooling to the room temperature.

BRIEF DESCRIPTION OF THE DRAWINGS

The present disclosure will be further illustrated by way of exemplary embodiments, which will be described in detail with accompanying drawings. These embodiments are not limiting, and in these embodiments, the same number denotes the same structure, wherein.

DETAILED DESCRIPTION

Figure 1:
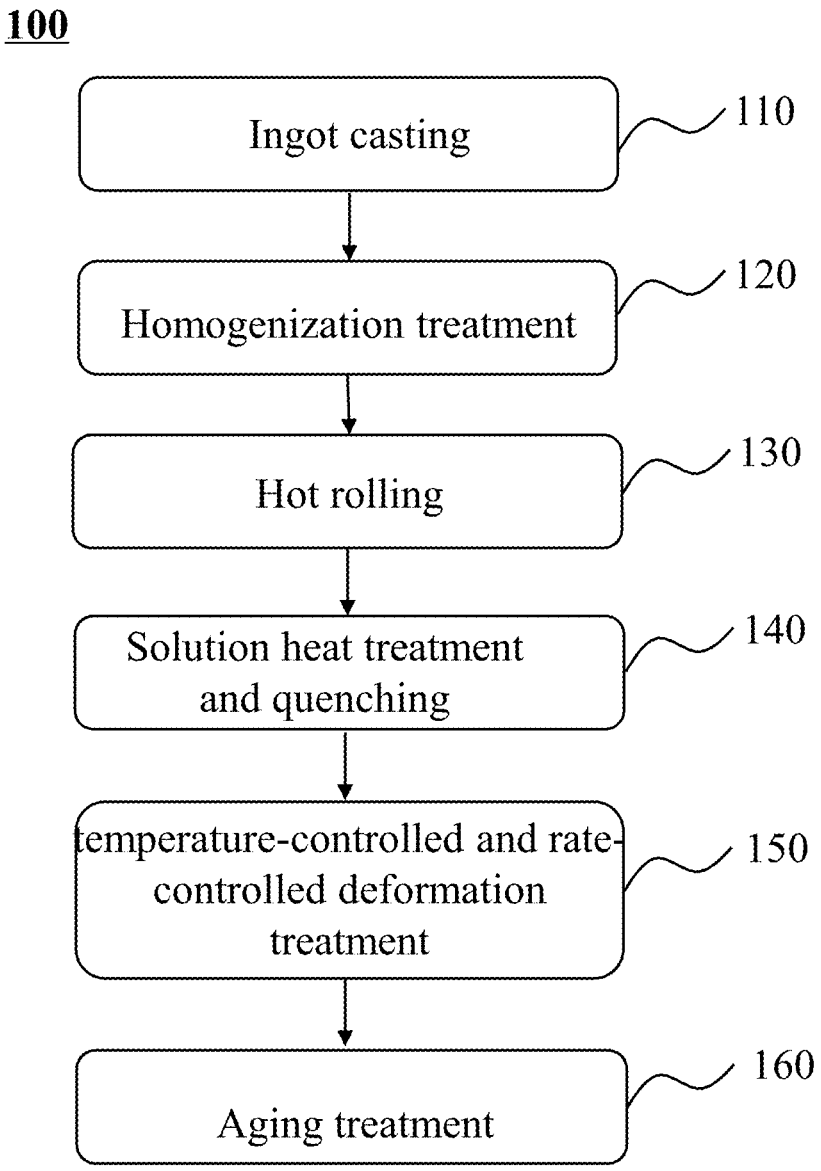
FIG. 1 is an exemplary flowchart illustrating an efficient aging method for an aluminum-lithium alloy based on dynamic strain precipitation according to some embodiments of the present disclosure.

The accompanying drawings, which are required to be used in the description of the embodiments, are briefly described below. The accompanying drawings do not represent the entirety of the embodiments.

Unless the context clearly suggests an exception, at least one of the words "one", "a", "an", or "the" do not refer specifically to the singular, but may also include the plural. Generally, the terms "including" and "comprising" only suggest the inclusion of explicitly identified steps and elements that do not constitute an exclusive list, and the method or devices may also include other steps or elements.

The precipitation process of the new aluminum-lithium alloy is complex. Due to the influence of alloying elements, precipitation phases of the alloy include δ'($Al_3Li$), θ'($Al_2Cu$), S'($Al_2CuMg$), and T1($Al_2CuLi$), and different precipitation phases have different structural characteristics and precipitation features, which brings different effects on alloy properties. During plastic deformation, the δ' phase leads to stress concentration and deterioration of alloy plasticity. In corrosive environments, the θ' phase leads to pitting of matrix. In the aluminum-lithium alloys with low or medium Cu/Li ratios, the $T_1$ phase has the best aging-strengthening effect on the alloy, and the $T_1$ phase grows by consuming the δ' phase and the θ' phase during the aging process.

However, during the heat treatment process, atomic polarization zones (GP zones) are generated in the matrix, in which the atoms are Cu and the strengthening effect of Cu on the matrix is much smaller than that of the $T_1$ phase. However, there is a competitive precipitation relationship between the $T_1$ phase and the GP zones, and an increase of the GP zones may lead to a reduction in strength, hardness, and other properties of the alloy. To improve the strengthening effect on the matrix, it is necessary to increase the content of the $T_1$ phase and reduce the generation of the GP zones.

In the prior art, dislocations are introduced in the matrix by cold deformation treatment before aging treatment to promote $T_1$ phase precipitation. In processing technology of the aluminum-lithium alloys, there are many heat treatment processes to improve the mechanical properties of the matrix, among which T6 treatment (cold deformation+solution heat treatment+aging) and T8 treatment (solution heat treatment+cold deformation+aging) are used. It has been reported that 2195 aluminum-lithium alloy undergoes the solution heat treatment, followed by 3%-6% pre-deformation and aging treatment, and the amount of the $T_1$ phase effectively increases with the prolonging of the aging time. However, the T8 treatment requires a longer aging time and does not completely inhibit the formation of the GP zones, which reduces the amount density of the $T_1$ phase precipitation. For example, when double-stage aging is used, the cold deformation combined with the double-stage aging is capable of increasing the generation of the $T_1$ phase in the matrix and reducing the formation of the GP zones, but a plurality of the GP zones still exists in the aluminum-lithium alloy treated in this way, and the aging time used in the T8 treatment is long, which also leads to high energy consumption.

To avoid the above problems, some embodiments of the present disclosure provide an efficient aging method for an aluminum-lithium alloy based on dynamic strain precipitation, which can effectively improve the comprehensive mechanical properties of the aluminum-lithium alloy while saving time and energy consumption.

FIG. 1 is an exemplary flowchart illustrating an efficient aging method for an aluminum-lithium alloy based on dynamic strain precipitation according to some embodiments of the present disclosure. In some embodiments, one or more additional operations not described herein may be added and/or one or more operations discussed herein may be deleted when completing a process 100. Additionally, the order of the operations shown in FIG. 1 is not limiting. As shown in FIG. 1, the process 100 includes operations 110-160.

In some embodiments, the efficient aging method for the aluminum-lithium alloy based on dynamic strain precipitation includes ingot casting, homogenization treatment, hot rolling, solution heat treatment and quenching, and aging treatment of the aluminum-lithium alloy. The method further includes temperature-controlled and rate-controlled deformation treatment between the solution heat treatment and quenching and the aging treatment. The temperature-controlled and rate-controlled deformation treatment includes performing preheating, temperature-controlled and rate-controlled hot rolling, and cooling treatment on an aluminum-lithium alloy sheet after the solution heat treatment and quenching in sequence. The temperature-controlled and rate-controlled hot rolling has a rolling temperature of 250° C.-330° C., a rolling reduction of 10%-30%, and a strain rate of 0.001 $s^{-1}$-0.5 $s^{-1}$, and an alloy chemical composition of the aluminum-lithium alloy includes Cu: 2.7 wt %-2.8 wt %, Li: 1.7 wt %-1.9 wt %, Mg: 0.3 wt %-0.5 wt %, Mn: 0.3 wt %-0.5 wt %, Zn: 0.5 wt %-0.7 wt %, Zr: 0.08 wt %-0.12 wt %, Si≤0.05 wt %, and Fe≤0.07 wt %.

The aluminum-lithium alloy refers to an alloy obtained by adding lithium as an alloying element to aluminum. In some embodiments, the alloy chemical composition of the aluminum-lithium alloy includes Cu: 2.7 wt %-2.8 wt %, Li: 1.7 wt %-1.9 wt %, Mg: 0.3 wt %-0.5 wt %, Mn: 0.3 wt %-0.5 wt %, Zn: 0.5 wt %-0.7 wt %, Zr: 0.08 wt %-0.12 wt %, Si≤0.05 wt %, and Fe≤0.07 wt %.

In operation 110, ingot casting.

The ingot casting refers to a process in which molten metal is injected into a casting mold and solidified into a metal ingot. In some embodiments, an aluminum-lithium alloy ingot is obtained by the ingot casting. The aluminum-lithium alloy ingot refers to an ingot that is made of the aluminum-lithium alloy by an ingot casting process.

In some embodiments, the aluminum-lithium alloy ingot may be prepared in a plurality of methods. For example, preparation methods include die casting, sand casting, gravity casting, or the like.

In some embodiments, the aluminum-lithium alloy ingot is prepared using a vacuum melting and casting method. The vacuum melting and casting method refers to a method in which the material is cast directly into products after high-temperature melting in a vacuum environment.

In operation 120, homogenization treatment.

The homogenization treatment refers to a process of homogenizing structure and eliminating stress of alloy material. Comprehensive performance of the aluminum-lithium alloy ingot may be improved by the homogenization treatment.

In some embodiments, the homogenization treatment of the aluminum-lithium alloy ingot includes performing the homogenization treatment on the aluminum-lithium alloy ingot for a homogenization time at a homogenization temperature. For example, the homogenization treatment is performed on the aluminum-lithium alloy ingot for 70 h-80 h at a range of 510° C.-530° C.

In some embodiments, the homogenization temperature is within a range of 510° C.-530° C. In some embodiments, the homogenization temperature is within a range of 515° C.-525° C. In some embodiments, the homogenization temperature is within a range of 518° C.-525° C. In some embodiments, the homogenization temperature is within a range of 519° C.-522° C.

In some embodiments, the homogenization time is within a range of 70 h-80 h. In some embodiments, the homogenization time is within a range of 71 h-79 h. In some embodiments, the homogenization time is within a range of 74 h-78 h. In some embodiments, the homogenization time is within a range of 75 h-77 h.

In operation 130, hot rolling.

The hot rolling refers to a metal processing technology in which the metal is rolled above its recrystallization temperature. Recrystallization refers to a process in which when an annealing temperature is high enough and the time is long enough, new grains with strain-free (i.e., cores of the recrystallization) are generated in fiber structures of the deformed metals or the alloys, and the new grains continue to grow until the original deformation structure completely disappears, and the properties of the metals or the alloys also undergo significant changes. The recrystallization temperature of the metal refers to a temperature at which the metal begins to form the new grains.

In some embodiments, the aluminum-lithium alloy ingot after the homogenization treatment is preheated at a preheat temperature, and after the whole reaches the preheat temperature, the preset temperature is held for a holding time, and then the hot rolling is performed on the aluminum-lithium alloy ingot to obtain an aluminum-lithium alloy sheet. For example, the aluminum-lithium alloy ingot after the homogenization treatment is preheated at a preheat temperature of 420° C.-460° C., and after the whole reaches the preheat temperature, the preset temperature is held for a holding time of 20 min-40 min, and then the hot rolling is performed on the aluminum-lithium alloy ingot to obtain the aluminum-lithium alloy sheet.

In some embodiments, the preheat temperature is within a range of 420° C.-460° C. In some embodiments, the preheat temperature is within a range of 430° C.-450° C. In some embodiments, the preheat temperature is within a range of 435° C.-445° C. In some embodiments, the preheat temperature is within a range of 438° C.-440° C.

In some embodiments, the holding time is within a range of 20 min-40 min. In some embodiments, the holding time is within a range of 25 min-35 min. In some embodiments, the holding time is within a range of 27 min-32 min. In some embodiments, the holding time is within a range of 28 min-30 min.

In operation 140, solution heat treatment and quenching.

The solution heat treatment and quenching refers to a heat treatment process in which the aluminum-lithium alloy sheet is heated to a high-temperature single-phase zone, and held at a constant temperature, so that an excess phase is fully dissolved into the solid solution and then cooled rapidly to obtain a supersaturated solid solution. The supersaturated solid solution refers to a solid solution in a metastable state in which the amount of dissolved solutes at a given temperature is greater than the amount of soluble at equilibrium at the temperature.

In some embodiments, the solution heat treatment is performed on the aluminum-lithium alloy sheet at a solution temperature for a solution time, and quenched using a medium with a medium temperature after the solution heat treatment is completed. The medium may include water, oil, air, liquid nitrogen, or the like. For example, the solution temperature of the solution heat treatment and quenching may be within a range of 535° C.-545° C., the solution time may be within a range of 0.9 h-1.2 h, and the quenching may be carried out with cold water at 25° C. as the medium after the solution heat treatment is completed.

In some embodiments, the solution temperature is within a range of 535° C.-545° C. In some embodiments, the solution temperature is within a range of 536° C.-544° C. In some embodiments, the solution temperature is within a range of 537° C.-543° C. In some embodiments, the solution temperature is within a range of 539° C.-541° C.

In some embodiments, the solution time is within a range of 0.9 h-1.2 h. In some embodiments, the solution time is within a range of 0.9 h-1.1 h. In some embodiments, the solution time is within a range of 1.0 h-1.2 h. In some embodiments, the solution time is within a range of 1.0 h-1.1 h.

In some embodiments, the medium temperature is 25° C. In some embodiments, the medium temperature is 24° C. In some embodiments, the medium temperature is 22° C. In some embodiments, the medium temperature is 20° C.

In operation 150, temperature-controlled and rate-controlled deformation treatment.

The temperature-controlled and rate-controlled deformation treatment refers to a heat treatment process in which a specific processing effect is achieved by controlling temperature and rate. In some embodiments, the temperature-controlled and rate-controlled deformation treatment includes performing the preheating, the temperature-controlled and rate-controlled hot rolling, and the cooling treatment on the aluminum-lithium alloy sheet after the solution heat treatment and quenching in sequence.

The preheating refers to a process of preheating the aluminum-lithium alloy sheet to the rolling temperature for the temperature-controlled and rate-controlled hot rolling.

In some embodiments, the preheating is to preheat the aluminum-lithium alloy sheet after the solution heat treatment and quenching to the rolling temperature of the temperature-controlled and rate-controlled hot rolling within the preheating time. For example, the preheating is to heat the aluminum-lithium alloy sheet after the solution heat treatment and quenching to a rolling temperature of the temperature-controlled and rate-controlled hot rolling within a range of 2 min-8 min.

In some embodiments, the preheating time is within a range of 2 min-8 min. In some embodiments, the preheating time is within a range of 3 min-5 min. In some embodiments, the preheating time is within a range of 3 min-6 min. In some embodiments, the preheating time is within a range of 4 min-6 min.

The temperature-controlled and rate-controlled hot rolling refers to the hot rolling of the aluminum-lithium alloy sheet after the preheating with controlled the rolling temperature and rate.

In some embodiments, the temperature-controlled and rate-controlled hot rolling is the hot rolling at a rolling temperature, a rolling reduction, and a strain rate. For example, the temperature-controlled and rate-controlled hot rolling is performed at a rolling temperature of 250° C.-330° C., a rolling reduction of 10%-30%, and a strain rate of 0.001 $s^{-1}$-0.5 $s^{-1}$.

In some embodiments, the rolling temperature is within a range of 250° C.-330° C. In some embodiments, the rolling temperature is within a range of 280° C.-320° C. In some embodiments, the rolling temperature is within a range of 285° C.-310° C. In some embodiments, the rolling temperature is within a range of 290° C.-300° C.

In some embodiments, the rolling reduction is within a range of 10%-30%. In some embodiments, the rolling reduction is within a range of 15%-25%. In some embodiments, the rolling reduction is within a range of 18%-22%. In some embodiments, the rolling reduction is within a range of 19%-20%.

In some embodiments, the strain rate is within a range of 0.001 $s^{-1}$-0.5 $s^{-1}$. In some embodiments, the strain rate is within a range of 0.01 $s^{-1}$-0.5 $s^{-1}$. In some embodiments, the strain rate is within a range of 0.1 $s^{-1}$-0.5 $s^{-1}$. In some embodiments, the strain rate is within a range of 0.025 $s^{-1}$-0.1 $s^{-1}$.

The cooling treatment refers to a process of cooling down the aluminum-lithium alloy sheet after the hot rolling using physical or chemical methods.

In some embodiments, the cooling treatment may be accomplished in a plurality of methods. For example, oil cooling, water cooling, air cooling, or the like.

In operation 160, aging treatment.

The aging treatment is a heat treatment process that promotes the phase transformation of metal or alloy material by controlling the temperature and time to improve its mechanical properties.

In some embodiments, the aging treatment may be accomplished in a plurality of methods. For example, high-temperature aging, low-temperature aging, or the like.

In some embodiments, the aging treatment is performing aging for an aging time at an aging temperature. For example, the aging treatment is performing aging for an aging time of 8 h-12 h at 160° C. In some embodiments, the aging treatment is followed by the cooling treatment. For example, air cooling to room temperature. More details regarding the cooling treatment may be found in other contents of the present disclosure (descriptions in connection with above).

In some embodiments, the aging temperature is within a range of 150° C.-200° C. In some embodiments, the aging temperature is within a range of 150° C.-190° C. In some embodiments, the aging temperature is within a range of 150° C.-180° C. In some embodiments, the aging temperature is within a range of 155° C.-170° C. In some embodiments, the aging temperature is 160° C.

In some embodiments, the aging time is within a range of 8 h-12 h. In some embodiments, the aging time is within a range of 8 h-11 h. In some embodiments, the aging time is within a range of 9 h-12 h. In some embodiments, the aging time is within a range of 9 h-11 h.

Figure 2:
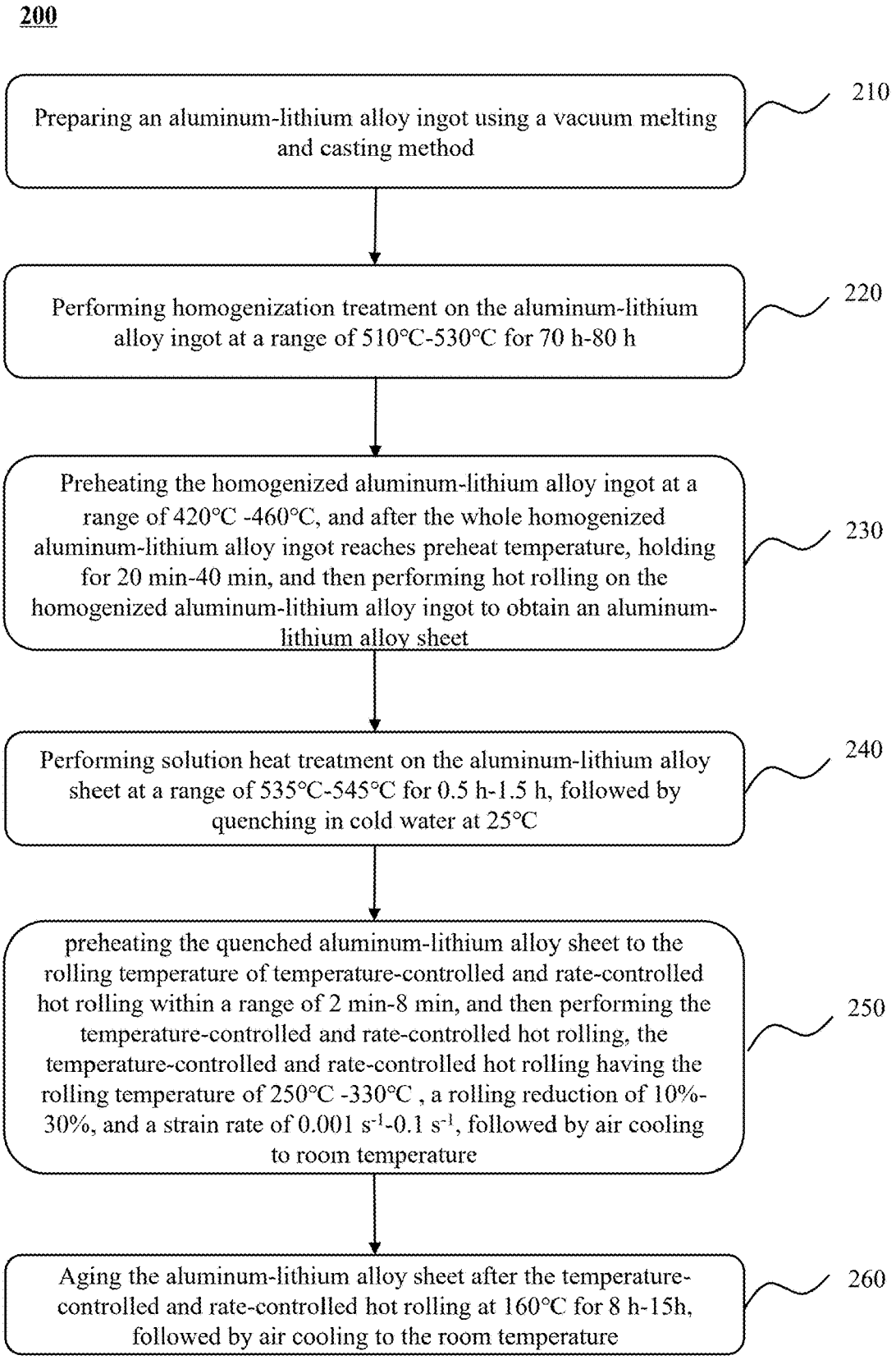
FIG. 2 is an exemplary flowchart illustrating an efficient aging method for an aluminum-lithium alloy based on dynamic strain precipitation according to other embodiments of the present disclosure.

More details regarding the ingot casting, the homogenization treatment, the hot rolling, the solution heat treatment and quenching, the temperature-controlled and rate-controlled deformation treatment, and the aging treatment may be found in other contents of the present disclosure (e.g., descriptions in connection with FIG. 2 and FIG. 3).

In some embodiments of the present disclosure, after the solution heat treatment and quenching, cold deformation is replaced by a temperature-controlled and rate-controlled hot rolling process, in which a large number of dispersed and fine $Al_2CuLi$ phases ($T_1$ phases) formed in the matrix are precipitated through dynamic strain, and simultaneously distributed on dislocation cell walls and in dislocation cells generated during the deformation of the temperature-controlled and rate-controlled hot rolling. The $Al_2CuLi$ phase is distributed in the dislocation cells in parallel and on the dislocation cell walls in a concentrated step-like manner, and this special dual distribution of precipitated phases is further strengthened in the subsequent aging process, which effectively improves the comprehensive mechanical properties of the aluminum-lithium alloy. At the same time, an addition of such specific temperature-controlled and rate-controlled hot rolling process eliminates a cold deformation step and a primary aging step, while the time of the secondary aging is greatly shortened, which effectively reduces time and energy consumption.

FIG. 2 is an exemplary flowchart illustrating an efficient aging method for an aluminum-lithium alloy based on dynamic strain precipitation according to other embodiments of the present disclosure. As shown in FIG. 2, a process 200 includes the following operations.

In some embodiments, an efficient aging method for an aluminum-lithium alloy based on dynamic strain precipitation is carried out as follow: (1) preparing an aluminum-lithium alloy ingot using a vacuum melting and casting method, an alloy chemical composition the aluminum-lithium alloy including: Cu: 2.7 wt %-2.8 wt %, Li: 1.7 wt %-1.9 wt %, Mg: 0.3 wt %-0.5 wt %, Mn: 0.3 wt %-0.5 wt %, Zn: 0.5 wt %-0.7 wt %, Zr: 0.08 wt %-0.12 wt %, Si≤0.05 wt %, Fe≤0.07 wt %, and the balance is aluminum; (2) performing homogenization treatment on the aluminum-lithium alloy ingot at a range of 510° C.-530° C. for 70 h-80 h; (3) preheating the homogenized aluminum-lithium alloy ingot at a range of 420° C.-460° C., and after the homogenized aluminum-lithium alloy ingot reaches a preheat temperature, holding for 20 min-40 min, and then performing hot rolling on the homogenized aluminum-lithium alloy ingot to obtain an aluminum-lithium alloy sheet; (4) performing solution heat treatment on the aluminum-lithium alloy sheet at a range of 535° C.-545° C. for 0.5 h-1.5 h, followed by quenching in cold water at 25° C.; (5) preheating the quenched aluminum-lithium alloy sheet to a rolling temperature of temperature-controlled and rate-controlled hot rolling within a range of 2 min-8 min, and then performing the temperature-controlled and rate-controlled hot rolling, wherein the temperature-controlled and rate-controlled hot rolling has the rolling temperature of 250° C.-330° C., a rolling reduction of 10%-30%, and a strain rate of 0.001 $s^{-1}$-0.1 $s^{-1}$, followed by air cooling to room temperature; and (6) aging the aluminum-lithium alloy sheet after the temperature-controlled and rate-controlled hot rolling at 160° C. for 8 h-15 h, followed by air cooling to the room temperature.

In operation 210, the aluminum-lithium alloy ingot is prepared using the vacuum melting and casting method. The alloy chemical composition of the aluminum-lithium alloy includes Cu: 2.7 wt %-2.8 wt %, Li: 1.7 wt %-1.9 wt %, Mg: 0.3 wt %-0.5 wt %, Mn: 0.3 wt %-0.5 wt %, Zn: 0.5 wt %-0.7 wt %, Zr: 0.08 wt %-0.12 wt %, Si≤0.05 wt %, Fe≤0.07 wt %, and the balance is aluminum.

More details regarding the ingot casting and the aluminum-lithium alloy may be found in other contents of the present disclosure (e.g., descriptions in connection with FIG. 1).

In operation 220, the homogenization treatment is performed on the aluminum-lithium alloy ingot for 70 h-80 h at a range of 510° C.-530° C.

More details regarding the homogenization treatment may be found in other contents of the present disclosure (e.g., descriptions in connection with FIG. 1).

In operation 230, the aluminum-lithium alloy ingot after the homogenization treatment is preheated at a range of 420° C.-460° C., and after the whole reaches the preheat temperature, the preset temperature is held for 20 min-40 min, and then the hot rolling is performed on the aluminum-lithium alloy ingot to obtain the aluminum-lithium alloy sheet.

More details regarding the hot rolling may be found in other contents of the present disclosure (e.g., descriptions in connection with FIG. 1).

The whole reaches the preheat temperature means that when the aluminum-lithium alloy ingot is preheated, the overall aluminum-lithium alloy ingot reaches the preheat temperature, i.e., the temperatures of points on the aluminum-lithium alloy ingot all reach the preheat temperature.

In operation 240, the solution heat treatment is performed on the aluminum-lithium alloy sheet at a range of 535° C.-545° C. for 0.5 h-1.5 h, followed by the quenching in the cold water at 25° C.

More details regarding the solution heat treatment and quenching may be found in other contents of the present disclosure (e.g., descriptions in connection with FIG. 1).

In operation 250, the quenched aluminum-lithium alloy sheet is preheated to the rolling temperature of the temperature-controlled and rate-controlled hot rolling within a range of 2 min-8 min, and then the temperature-controlled and rate-controlled hot rolling is performed on the preheated aluminum-lithium alloy sheet, and then the rolled aluminum-lithium alloy sheet is cooled down to the room temperature by air cooling. The rolling temperature of the temperature-controlled and rate-controlled hot rolling is within a range of 250° C.-330° C.; the rolling reduction is within a range of 10%-30%; and the strain rate is within a range of 0.001 $s^{-1}$-0.1 $s^{-1}$.

More details regarding the temperature-controlled and rate-controlled deformation treatment may be found in other contents of the present disclosure (e.g., descriptions in connection with FIG. 1).

In operation 260, the aging treatment is performed on the aluminum-lithium alloy sheet after the temperature-controlled and rate-controlled hot rolling at 160° C. for 8 h-15 h, and then followed by the air cooling to the room temperature.

More details regarding the aging treatment may be found in other contents of the present disclosure (e.g., descriptions in connection with FIG. 1).

In some embodiments of the present disclosure, the efficient aging method for the aluminum-lithium alloy based on dynamic strain precipitation can substantially shorten the time of the aging treatment of the aluminum-lithium alloy, reduce the energy consumption of the process, and at the same time promote the precipitation of the $T_1$ phase and inhibit the formation of GP, thereby optimizing the mechanical properties of the alloy. The peak aging time is shortened from the original range of 36 h-48 h to a range of less than 12 h.

The efficient aging method for the aluminum-lithium alloy based on dynamic strain precipitation may be described in detail below by Examples 1-4 and Comparative Example 1. It should be noted that the reaction conditions, reaction materials, and dosage of reaction materials in Examples 1-4 and Comparative Example 1 are only intended to illustrate the efficiency aging method for the aluminum-lithium alloy based on dynamic strain precipitation, and do not limit the scope of protection of this application.

Example 1

An efficient aging method for an aluminum-lithium alloy based on dynamic strain precipitation, includes following operations:

(1) preparing an aluminum-lithium alloy ingot by a vacuum melting and casting method, alloy chemical composition of the aluminum-lithium alloy including Cu: 2.7 wt %; Li: 1.8 wt %; Mg: 0.4 wt %; Mn: 0.4 wt %; Zn: 0.6 wt %; Zr: 0.1 wt %; Si: 0.05 wt %; Fe: 0.07 wt %; and the balance being aluminum;

(2) performing homogenization treatment on the aluminum-lithium alloy ingot at 520° C. for 75 h;

(3) preheating the homogenized aluminum-lithium alloy ingot at 450° C., and after the whole homogenized aluminum-lithium alloy ingot reaches preheat temperature, holding for 30 min, and then performing multi-pass hot rolling on the homogenized aluminum-lithium alloy ingot to obtain an aluminum-lithium alloy sheet;

(4) performing solution heat treatment on the aluminum-lithium alloy sheet at 540° C. for 1 h, followed by quenching in cold water at 25° C.;

(5) preheating the quenched aluminum-lithium alloy sheet to rolling temperature of temperature-controlled and rate-controlled hot rolling within 4 min, and then performing the temperature-controlled and rate-controlled hot rolling at 270° C., the temperature-controlled and rate-controlled hot rolling having a rolling reduction of 20% and a strain rate of 0.05 $s^{-1}$, followed by air cooling to room temperature;

(6) aging the aluminum-lithium alloy sheet after the temperature-controlled and rate-controlled hot rolling at 160° C. for 10 h, followed by the air cooling to the room temperature.

Figure 3A:
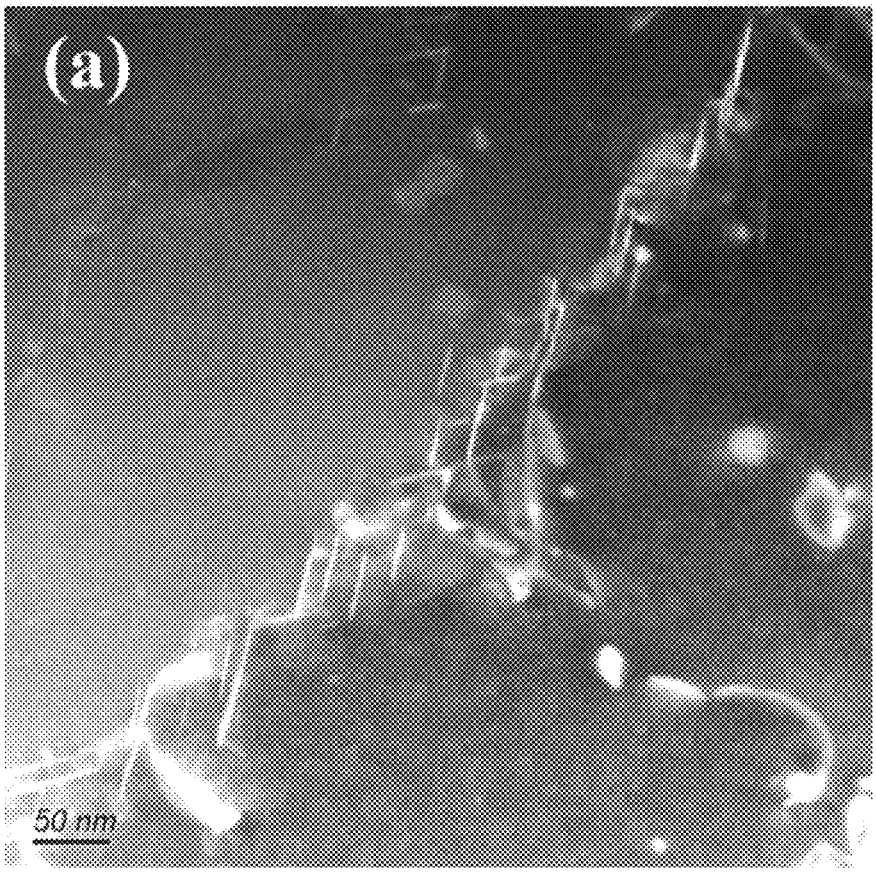
FIG. 3A is a scanning electron micrograph (SEM) image of an aluminum-lithium alloy prepared according to some embodiments of the present disclosure.
Figure 3B:
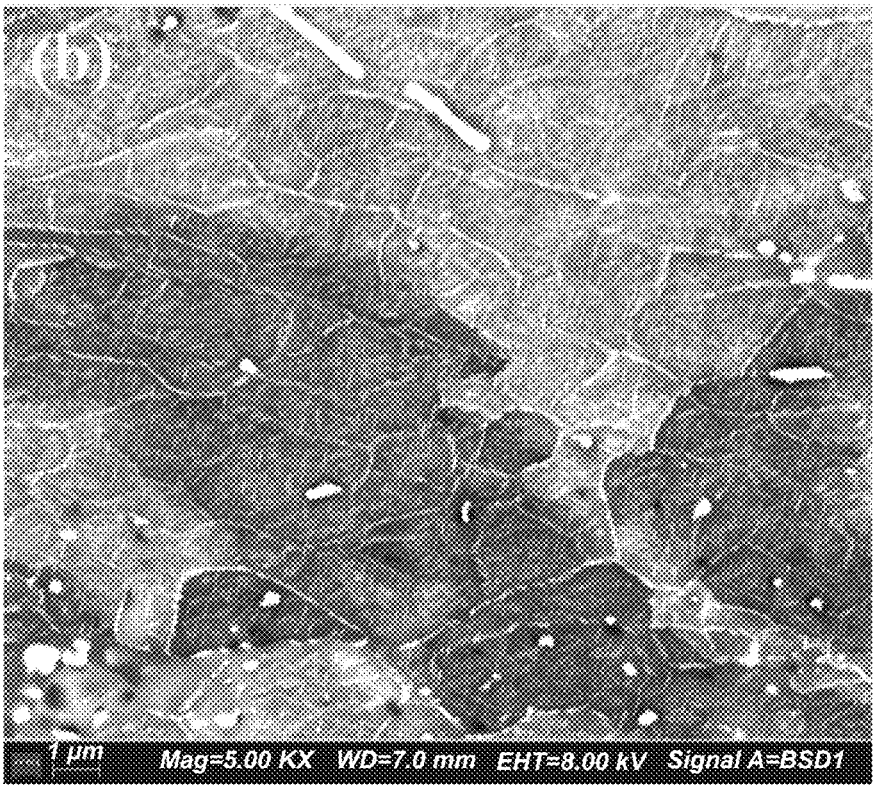
FIG. 3B is another SEM image of an aluminum-lithium alloy prepared according to some embodiments of the present disclosure.

The corresponding SEM images of the aluminum-lithium alloy prepared in Example 1 are shown in FIG. 3A and FIG. 3B. It may be seen from FIG. 3B that the $T_1$ phase is uniformly distributed in dislocation cells in the matrix, and it is evident from FIG. 3A that the $T_1$ phase is also centrally distributed on dislocation cell wall, specifically in a parallel step-like distribution.

On the basis of Example 1, changes of mechanical properties of the aluminum-lithium alloys processed under different aging times are tested by adjusting the aging time, and the results are shown in Table 1.

TABLE 1

Mechanical properties of sample aluminum-lithium alloys using temperature-controlled and rate-controlled hot rolling with rolling reduction of 20%

| Aging time | Orientation | Yield strength (MPa) | Tensile strength (MPa) | Elongation (%) |
|---|---|---|---|---|
| 4 h | 0° | 433.6 ± 3.1 | 481.6 ± 3.8 | 6.9 ± 0.6 |
| | 45° | 459.8 ± 7.6 | 529.2 ± 11.4 | 6.5 ± 0.5 |
| | 90° | 436.1 ± 2.9 | 495.3 ± 4.9 | 7.2 ± 1.2 |
| 10 h | 0° | 531.4 ± 1.8 | 577.5 ± 3.6 | 6.8 ± 0.4 |
| | 45° | 523.7 ± 6.4 | 571.2 ± 4.8 | 5.7 ± 0.3 |
| | 90° | 514.3 ± 5.2 | 570.8 ± 3.7 | 6.3 ± 0.5 |
| 12 h | 0° | 542.5 ± 8.7 | 578.6 ± 4.9 | 6.1 ± 0.2 |
| | 45° | 557.2 ± 3.6 | 573.1 ± 10.4 | 5.4 ± 0.3 |
| | 90° | 545.9 ± 4.2 | 569.8 ± 2.3 | 5.9 ± 0.6 |
| 24 h | 0° | 550.3 ± 10.5 | 579.6 ± 5.8 | 2.6 ± 0.8 |
| | 45° | 561.4 ± 2.8 | 591.1 ± 11.2 | 2.1 ± 0.9 |
| | 90° | 552.7 ± 6.3 | 580.8 ± 1.4 | 3.0 ± 0.1 |

It may be seen that, in the case of the rolling reduction of 20%, the yield strength and the tensile strength of the aluminum-lithium alloys increase with the increase of the aging time, and when the aging time of up to 24 h, although there is a significant increase in the yield strength, the increase in the tensile strength is not obvious, and the elongation of the alloy decreases more seriously.

Comparative Example 1

Processing is carried out by conventional cold deformation and long aging processing as follows:

(1) preparing an aluminum-lithium alloy ingot by a vacuum melting and casting method, alloy chemical composition of the aluminum-lithium alloy including: Cu: 2.7 wt %; Li: 1.8 wt %; Mg: 0.4 wt %; Mn: 0.4 wt %; Zn: 0.6 wt %; Zr: 0.1 wt %; Si: 0.05 wt %; Fe: 0.07 wt %; and the balance being aluminum;

(2) performing homogenization treatment on the aluminum-lithium alloy ingot at 520° C. for 75 h;

(3) preheating the homogenized aluminum-lithium alloy ingot at 450° C., and after the whole homogenized aluminum-lithium alloy ingot reaches preheat temperature, holding for 30 min, and then performing multi-pass hot rolling on the homogenized aluminum-lithium alloy ingot to obtain an aluminum-lithium alloy sheet;

(4) performing solution heat treatment on the aluminum-lithium alloy sheet at 540° C. for 1 h, followed by quenching in cold water at 25° C.

(5) pre-deforming the quenched aluminum-lithium alloy sheet with deformation amount in a range of 3%-6%;

(6) aging the aluminum-lithium alloy sheet after pre-deformation treatment at 160° C. for an aging time of 16 h-36 h, followed by air cooling to room temperature.

The effects of changes of deformation amount and aging time on mechanical properties of the aluminum-lithium alloys under different conditions in Comparative Example 1 are shown in Table 2, in which T83 and T86 indicate the T8 heat treatment process with the deformation amount of 3% and 6%, respectively.

TABLE 2

Mechanical properties of aluminum-lithium alloys prepared by typical T8 treatment

| | | T83 | | | T86 | | |
|---|---|---|---|---|---|---|---|
| Aging time | Orientation | Yield strength (MPa) | Tensile strength (MPa) | Elongation (%) | Yield strength (MPa) | Tensile strength (MPa) | Elongation (%) |
| 16 h | 0° | 429.7 ± 3.2 | 454.6 ± 1.4 | 6.9 ± 0.4 | 454.2 ± 3.4 | 478.4 ± 4.8 | 6.4 ± 0.3 |
| | 45° | 424.5 ± 1.8 | 443.9 ± 2.2 | 6.4 ± 0.2 | 438.7 ± 2.1 | 564.9 ± 2.7 | 5.9 ± 0.2 |
| | 90° | 411.3 ± 2.6 | 428.7 ± 3.4 | 7.9 ± 0.4 | 432.8 ± 11.2 | 557.2 ± 8.4 | 6.9 ± 0.8 |
| 24 h | 0° | 434.6 ± 2.0 | 466.5 ± 1.6 | 6.6 ± 0.2 | 469.8 ± 4.4 | 498.2 ± 2.9 | 6.5 ± 0.1 |
| | 45° | 430.8 ± 1.4 | 450.4 ± 1.8 | 6.1 ± 0.4 | 461.2 ± 3.7 | 481.5 ± 5.6 | 6.1 ± 0.3 |
| | 90° | 419.4 ± 2.3 | 436.8 ± 2.5 | 6.8 ± 0.5 | 449.6 ± 1.8 | 477.2 ± 7.2 | 6.8 ± 0.4 |
| 36 h | 0° | 455.2 ± 2.6 | 477.2 ± 2.1 | 6.9 ± 0.2 | 492.4 ± 2.8 | 517.4 ± 5.6 | 6.7 ± 0.6 |
| | 45° | 449.3 ± 1.8 | 461.6 ± 1.2 | 6.7 ± 0.1 | 479.7 ± 7.1 | 504.5 ± 4.1 | 6.5 ± 0.1 |
| | 90° | 431.5 ± 2.4 | 442.3 ± 2.9 | 7.4 ± 0.4 | 468.8 ± 3.9 | 498.2 ± 6.2 | 7.1 ± 0.2 |
| 48 h | 0° | 442.3 ± 3.2 | 477.1 ± 1.2 | 7.1 ± 0.2 | 501.2 ± 1.7 | 512.5 ± 5.3 | 7.2 ± 0.2 |
| | 45° | 431.6 ± 2.2 | 456.2 ± 3.1 | 6.9 ± 0.1 | 483.5 ± 4.2 | 504.6 ± 1.8 | 6.9 ± 0.4 |
| | 90° | 419.8 ± 1.2 | 452.6 ± 2.0 | 7.2 ± 0.4 | 470.2 ± 7.4 | 499.4 ± 9.2 | 7.6 ± 0.3 |

It may be seen that, under the same condition, the increase in deformation amount improves the yield strength and the tensile strength to a certain extent, and at the same deformation amount, with the increase in aging time, the mechanical properties of the alloy are also gradually improved. In the early period, when the aging time is prolonged, the elongation does not change significantly, and when the aging time is prolonged to more than 36 h, the elongation of the alloy increases significantly.

According to Example 1 and Comparative Example 1, it may be concluded that in Example 1, the aluminum-lithium alloys with high yield strength and high tensile strength may be obtained within a very short aging time. In contrast, to achieve the aluminum-lithium alloys with relatively high yield strength and high tensile strength in Comparative Example 1, the aging time needs to be prolonged to more than 36 h, which may increase energy consumption, and the yield strength and the tensile strength of the aluminum-lithium alloys prepared by prolonging the aging time in Comparative Example 1 are still lower than those of the aluminum-lithium alloys prepared within a shorter aging time (e.g., 10 h or 12 h) in Example 1.

Example 2

On the basis of Example 1, rolling reduction during temperature-controlled and rate-controlled hot rolling was adjusted to test mechanical properties of each alloy, and the results are shown in Table 3.

TABLE 3

Mechanical properties of sample aluminum-lithium alloys prepared under different rolling reductions

| Rolling reduction (%) | Orientation | Yield strength (MPa) | Tensile strength (MPa) | Elongation (%) |
|---|---|---|---|---|
| 10 | 0° | 487.4 ± 2.7 | 530.6 ± 4.8 | 7.0 ± 0.3 |
| 15 | 0° | 504.2 ± 1.5 | 539.5 ± 2.7 | 6.9 ± 0.2 |
| 20 | 0° | 531.4 ± 1.8 | 577.5 ± 3.6 | 6.8 ± 0.4 |
| 25 | 0° | 544.7 ± 1.6 | 589.2 ± 4.5 | 4.7 ± 0.7 |
| 30 | 0° | 552.2 ± 2.1 | 597.1 ± 1.9 | 5.1 ± 1.2 |

It may be seen from the above table that the yield strength and the tensile strength of the alloys increase gradually with the increase of the rolling reductions. When the rolling reduction is within a range of 15-20%, the yield strength and the tensile strength of the alloys keep at a high level while the elongation the alloys also keep at a good level. However, as the rolling reduction continues to increase, although the yield strength and the tensile strength of the alloys further increase, the elongation of the alloys decreases significantly.

Example 3

An efficient aging method for an aluminum-lithium alloy based on dynamic strain precipitation includes following operations:

(1) preparing an aluminum-lithium alloy ingot by a vacuum melting and casting method, alloy chemical composition of the aluminum-lithium alloy including: Cu: 2.8 wt %; Li: 1.9 wt %; Mg: 0.5 wt %; Mn: 0.5 wt %; Zn: 0.7 wt %; Zr: 0.12 wt %; Si: 0.05 wt %; Fe: 0.07 wt %; and the balance being aluminum;

(2) performing homogenization treatment on the aluminum-lithium alloy ingot at 510° C. for 80 h;

(3) preheating the homogenized aluminum-lithium alloy ingot at 420° C., and after the whole homogenized aluminum-lithium alloy ingot reaches preheat temperature, holding for 40 min, and then performing multi-pass hot rolling on the homogenized aluminum-lithium alloy ingot to obtain an aluminum-lithium alloy sheet;

(4) performing solution heat treatment on the aluminum-lithium alloy sheet at 535° C. for 1.5 h, followed by quenching in cold water at 25° C.;

(5) preheating the quenched aluminum-lithium alloy sheet to rolling temperature of temperature-controlled and rate-controlled hot rolling within 2 min, and then performing the temperature-controlled and rate-controlled hot rolling at 330° C., the temperature-controlled and rate-controlled hot rolling having a rolling reduction of 20% and a strain rate of 0.001 $s^{-1}$, followed by air cooling to room temperature;

(6) aging the aluminum-lithium alloy sheet after the temperature-controlled and rate-controlled hot rolling at 160° C. for 10 h, followed by the air cooling to the room temperature.

Mechanical properties of sample aluminum-lithium alloys prepared in Example 3 are shown in Table 4.

TABLE 4

Mechanical properties of sample aluminum-lithium alloys prepared in Example 3

| Orientation | Yield strength (MPa) | Tensile strength (MPa) | Elongation (%) |
|---|---|---|---|
| 0° | 514.6 ± 4.7 | 565.7 ± 4.3 | 6.5 ± 0.8 |
| 45° | 503.8 ± 5.9 | 551.2 ± 3.8 | 6.1 ± 0.4 |
| 90° | 509.3 ± 1.6 | 562.6 ± 2.4 | 6.4 ± 0.5 |

It may be seen from the above table that the aluminum-lithium alloy prepared in Example 3 has excellent mechanical properties.

Example 4

An efficient aging method for an aluminum-lithium alloy based on dynamic strain precipitation, includes following operations:

(1) preparing an aluminum-lithium alloy ingot by a vacuum melting and casting method, alloy chemical composition of the aluminum-lithium alloy including: Cu: 2.8 wt %; Li: 1.7 wt %; Mg: 0.3 wt %; Mn: 0.3 wt %; Zn: 0.5 wt %; Zr: 0.08 wt %; Si: 0.05 wt %; Fe: 0.07 wt %; and the balance being aluminum;

(2) performing homogenization treatment on the aluminum-lithium alloy ingot at 530° C. for 70 h;

(3) preheating the homogenized aluminum-lithium alloy ingot at 460° C., and after the whole homogenized aluminum-lithium alloy ingot reaches preheat temperature, holding for 20 min, and then performing hot rolling on the homogenized aluminum-lithium alloy ingot to obtain an aluminum-lithium alloy sheet;

(4) performing solution heat treatment on the aluminum-lithium alloy sheet at 545° C. for 0.5 h, followed by quenching in cold water at 25° C.;

(5) preheating the quenched aluminum-lithium alloy sheet to the rolling temperature of temperature-controlled and rate-controlled hot rolling within 8 min, and then performing the temperature-controlled and rate-controlled hot rolling at 250° C., the temperature-controlled and rate-controlled hot rolling having a rolling reduction of 20% and a strain rate of 0.1 $s^{-1}$, followed by air cooling to room temperature;

(6) aging the aluminum-lithium alloy sheet after the temperature-controlled and rate-controlled hot rolling at 160° C. for 10 h, followed by the air cooling to room temperature.

Mechanical properties of the sample aluminum-lithium alloys prepared in Example 4 are shown in Table 5.

TABLE 5

Mechanical properties of sample aluminum-lithium alloys prepared in Example 4

| Orientation | Yield strength (MPa) | Tensile strength (MPa) | Elongation (%) |
|---|---|---|---|
| 0° | 507.1 ± 2.4 | 552.5 ± 1.7 | 6.5 ± 0.5 |
| 45° | 498.7 ± 3.7 | 537.4 ± 3.4 | 5.4 ± 0.7 |
| 90° | 506.3 ± 3.9 | 549.6 ± 2.6 | 6.4 ± 0.4 |

It may be seen from the above table that the aluminum-lithium alloy prepared in Example 4 has excellent mechanical properties.

The embodiments of the present disclosure bring beneficial effects including, but are not limited to: (1) substantially shortening the aging treatment time of the aluminum-lithium alloy and reducing the energy consumption of the process; and (2) facilitating the precipitation of the T1 phase and inhibiting the formation of the GP, optimizing the mechanical properties of the alloy.

When describing the operations performed in the embodiments of the present disclosure in steps, the order of the steps is all interchangeable, the steps may be omitted, and other steps may be included in the course of the operations, if not otherwise specified.

The embodiments in the present disclosure are for the purpose of exemplification and illustration only and do not restrict the scope of application of the present disclosure. For a person skilled in the art, various corrections and changes that may be made under the guidance of the present disclosure remain the scope of the present disclosure.

Some features, structures, or characteristics of one or more embodiments of the present disclosure may be suitably combined.

Numbers describing the number of components and properties are used in some embodiments. It is to be understood that such numbers used in the description of embodiments are modified in some examples by the modifiers "about", "approximately", or "substantially". Unless otherwise noted, the terms "about," "approximately," or "substantially" indicate that a ±20% variation in the stated number is allowed. Correspondingly, in some embodiments, the numerical parameters used in the disclosure and claims are approximations, which may change according to the desired characteristics of individual embodiments. While the numerical domains and parameters used in some embodiments of the present disclosure to confirm the breadth of their ranges are approximations, in specific embodiments such values are set to be as precise as possible within a feasible range.

In the event of any inconsistency or conflict between at least one of the descriptions, definitions, or use of terms in the materials cited in the present disclosure and those described in the present disclosure, at least one of the descriptions, definitions, or use of terms in the present disclosure shall prevail.

What is claimed is:

1. An efficient aging method for an aluminum-lithium alloy based on dynamic strain precipitation, comprising: ingot casting, homogenization treatment, hot rolling, solution heat treatment and quenching, and aging treatment, wherein the method further comprises temperature-controlled and rate-controlled deformation treatment between the solution heat treatment and quenching and the aging treatment, the temperature-controlled and rate-controlled deformation treatment includes performing preheating, temperature-controlled and rate-controlled hot rolling, and cooling treatment on an aluminum-lithium alloy sheet after the solution heat treatment and quenching in sequence, the temperature-controlled and rate-controlled hot rolling has a rolling temperature of 250° C.-330° C., a rolling reduction of 10%-30%, and a strain rate of 0.001 $s^{-1}$-0.5 $s^{-1}$, and an alloy chemical composition of the aluminum-lithium alloy includes Cu: 2.7 wt %-2.8 wt %, Li: 1.7 wt %-1.9 wt %, Mg: 0.3 wt %-0.5 wt %, Mn: 0.3 wt %-0.5 wt %, Zn: 0.5 wt %-0.7 wt %, Zr: 0.08 wt %-0.12 wt %, Si≤0.05 wt %, and Fe≤0.07 wt %.

2. The method of claim 1, wherein the preheating includes heating the aluminum-lithium alloy sheet after the solution heat treatment and quenching to the rolling temperature of the temperature-controlled and rate-controlled hot rolling within a range of 2 min-8 min.

3. The method of claim 1, wherein a solution temperature of the solution heat treatment and quenching is within a range of 535° C.-545° C., and a solution time of the solution heat treatment and quenching is within a range of 0.9 h-1.2 h, and quenching is performed using cold water at 25° C. as a medium after the solution heat treatment.

4. The method of claim 1, wherein the aging treatment is performed at 160° C. for 8 h-15 h, followed by air cooling to room temperature.

5. An efficient aging method for an aluminum-lithium alloy based on dynamic strain precipitation, comprising:

(1) preparing an aluminum-lithium alloy ingot by a vacuum melting and casting method, wherein alloy chemical composition of the aluminum-lithium alloy includes Cu: 2.7 wt %-2.8 wt %, Li: 1.7 wt %-1.9 wt %, Mg: 0.3 wt %-0.5 wt %, and Mn: 0.3 wt %-0.5 wt %, Zn: 0.5 wt %-0.7 wt %, Zr: 0.08 wt %-0.12 wt %, Si≤0.05 wt %, Fe≤0.07 wt %, and the balance is aluminum;

(2) performing homogenization treatment on the aluminum-lithium alloy ingot at a range of 510° C.-530° C. for 70 h-80 h;

(3) preheating the homogenized aluminum-lithium alloy ingot at a range of 420° C.-460° C., and after the whole homogenized aluminum-lithium alloy ingot reaches a preheat temperature, holding for 20 min-40 min, and then performing hot rolling on the homogenized aluminum-lithium alloy ingot to obtain an aluminum-lithium alloy sheet;

(4) performing solution heat treatment on the aluminum-lithium alloy sheet at a range of 535° C.-545° C. for 0.5 h-1.5 h, followed by quenching in cold water at 25° C.;

(5) preheating the quenched aluminum-lithium alloy sheet to a rolling temperature of temperature-controlled and rate-controlled hot rolling within a range of 2 min-8 min, and then performing the temperature-controlled and rate-controlled hot rolling, wherein the temperature-controlled and rate-controlled hot rolling has the rolling temperature of 250° C.-330° C., a rolling reduction of 10%-30%, and a strain rate of 0.001 $s^{-1}$-0.1 $s^{-1}$, followed by air cooling to room temperature; and (6) aging the aluminum-lithium alloy sheet after the temperature-controlled and rate-controlled hot rolling at 160° C. for 8 h-15 h, followed by air cooling to the room temperature.

* * * * *